US011255000B2

(12) United States Patent
Yang et al.

(10) Patent No.: US 11,255,000 B2
(45) Date of Patent: Feb. 22, 2022

(54) COPPER ALLOY AND APPLICATION THEREOF

(71) Applicant: NINGBO POWERWAY ALLOY MATERIAL CO.,LTD., Zhejiang (CN)

(72) Inventors: Chaoyong Yang, Zhejiang (CN); Jiangang Li, Zhejiang (CN); Ning Li, Zhejiang (CN); Taisheng Yang, Zhejiang (CN); Hongbin Zhao, Zhejiang (CN); Yaohua Zhou, Zhejiang (CN)

(73) Assignee: NINGBO POWERWAY ALLOY MATERIAL CO., LTD., Zhejiang (CN)

( * ) Notice: Subject to any disclaimer, the term of this patent is extended or adjusted under 35 U.S.C. 154(b) by 195 days.

(21) Appl. No.: 16/607,720

(22) PCT Filed: Jul. 19, 2018

(86) PCT No.: PCT/CN2018/000260

§ 371 (c)(1),
(2) Date: Oct. 24, 2019

(87) PCT Pub. No.: WO2019/237215

PCT Pub. Date: Dec. 19, 2019

(65) Prior Publication Data

US 2021/0147961 A1 May 20, 2021

(30) Foreign Application Priority Data

Jun. 12, 2018 (CN) ..... 201810619465.3

(51) Int. Cl.
*C22C 9/04* (2006.01)

(52) U.S. Cl.
CPC ..... *C22C 9/04* (2013.01)

(58) Field of Classification Search
None
See application file for complete search history.

(56) References Cited

U.S. PATENT DOCUMENTS

2015/0325326 A1* 11/2015 Maki ..... C23C 30/005
428/647

FOREIGN PATENT DOCUMENTS

CN 107974574 5/2018
JP 201117072 A † 1/2011
(Continued)

OTHER PUBLICATIONS

"International Search Report (Form PCT/ISA/210) of PCT/CN2018/000260," dated Mar. 11, 2019, pp. 1-4.

*Primary Examiner* — Adam Krupicka
(74) *Attorney, Agent, or Firm* — JCIP Global Inc.

(57) ABSTRACT

The present invention discloses a copper alloy, which includes: 5 wt % to 15 wt % of Zn, 0.2 wt % to 2.5 wt % of Sn, 0.1 wt % to 2.0 wt % of Ni, 0.01 wt % to 0.3 wt % of P, 0 to 0.3 wt % of Mg, 0 to 0.5 wt % of Fe, and a balance of Cu and inevitable impurities. Preferably, it is controlled that 1.0 wt %≤Ni+Sn≤3.5 wt %, the weight ratio of Ni to Sn is 0.08 to 10; the weight ratio of Ni to P is 2 to 15, Ni and P form a NiP compound in a matrix. During the crystal orientation analysis using EBSD measurement, the area in a Brass orientation {011}<211> at a derivation angle of less than 15° accounts for 10% to 25%. The yield strength 600 MPa, the electrical conductivity is ≥25% IACS, and the bending machinability is excellent because the value R/t in a GW direction is ≤1 and the value R/t in a BW direction is ≤2.

11 Claims, 1 Drawing Sheet

(56) References Cited

FOREIGN PATENT DOCUMENTS

| | | | |
|---|---|---|---|
| JP | 2013213236 | | 10/2013 |
| JP | WO2012026611 | | 10/2013 |
| JP | 2014129569 | | 7/2014 |
| WO | 0029632 | | 5/2000 |
| WO | 0029632 | A1 † | 5/2000 |

* cited by examiner
† cited by third party

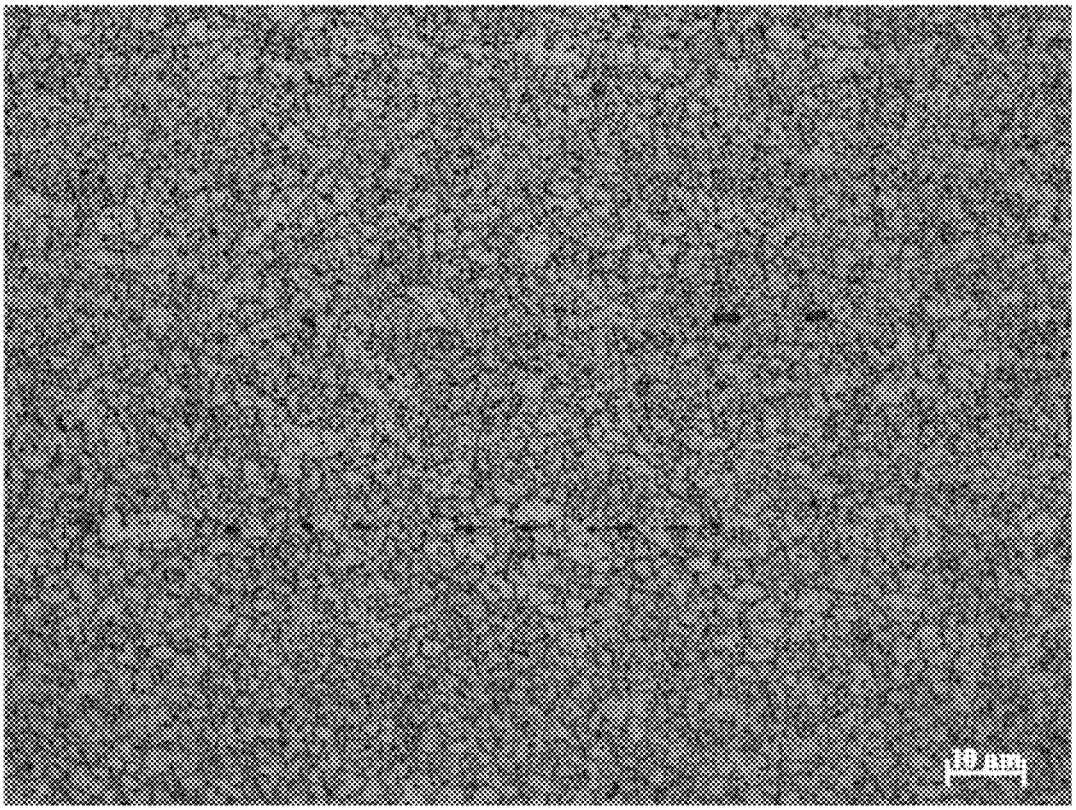
10 μm

COPPER ALLOY AND APPLICATION THEREOF

CROSS-REFERENCE TO RELATED APPLICATION

This application is a 371 of international application of PCT application serial no. PCT/CN2018/000260, filed on Jul. 19, 2018, which claims the priority benefit of China application no. 201810619465.3, filed on Jun. 12, 2018. The entirety of each of the above mentioned patent applications is hereby incorporated by reference herein and made a part of this specification.

TECHNICAL FIELD OF THE INVENTION

The present invention relates to the field of alloys, and in particular to a copper alloy and an application thereof.

BACKGROUND OF THE INVENTION

Copper and copper alloy materials having good electrical conductivity and high strength are always used as important constituent materials of connectors, terminals and switches for electrical components, automobile components, communication devices and the like. As the devices become smaller and lighter and have higher performances in recent years, these constituent materials are more strictly required in performance improvement. The performances include the strength, electrical conductivity, stress relaxation resistance and bending machinability of the material.

The bending machinability is an important factor affecting the application of the material. With the miniaturization of terminals, the radius of curvature for bending machining of a contact portion is reduced, and the bending machining of the material is more strictly required than ever before. Therefore, there are often cracks or wrinkles on the surface of the material. If cracks occur in the bending machining portion, the contact force of the contact portion is reduced, and the contact resistance of the contact portion is increased, so that the temperature rise will exceed the allowable value of the device and the normal operation of the device is thus influenced. Meanwhile, with the miniaturization of the device, the constituent material is required to be thinner and lighter, and the strength of the material is also more highly required. There is a tradeoff between the strength and the bending machinability, so it is very difficult to improve the two performances at the same time.

At present, the constituent materials are generally brass, tin-phosphor bronze, beryllium copper and the like, but these alloys cannot meet the requirements for the development and application of connectors, terminals and switches. Although the brass alloy is low in cost, it is difficult to meet highly-required fields in terms of strength, electrical conductivity, stress relaxation resistance and bending machinability. The tin-phosphor bronze is a copper alloy that is widely applied in fields of connectors and terminals at present and has high strength, but the electrical conductivity is less than or equal to 20% IACS, so that the application requirements of the existing high-performance connectors for high-conductivity conditions cannot be met. Meanwhile, considering the high price of Sn, the application of the tin-phosphor bronze in some fields is limited. Since beryllium contained in the beryllium copper is toxic and the beryllium copper is expensive, the beryllium copper is generally applied in certain fields with high requirements for elasticity and strength.

To compensate for the deficiencies of the brass and phosphor bronze in performance, C42500 has proposed adding Sn element to improve the comprehensive performance of the alloy. Although the comprehensive performance of the alloy is improved, it is still difficult to balance the performances such as electrical conductivity, strength, bending machinability and stress relaxation resistance to meet the application requirements.

JP2014129569A has proposed improving the bending machinability by controlling the crystal orientation. In a Cu—Zn—Sn system alloy, the bending machinability is excellent in the case of a crystal orientation having an X-ray diffraction intensity from faces {220} and {311} satisfying conditions. JP2013213236A has proposed that, in the alloy system, the bending machinability is excellent in the case of a crystal orientation having an X-ray diffraction intensity from faces {200}, {220} and {311} satisfying conditions. However, in the technologies, the aggregation of particular crystal faces defined by {200}, {220}, {311} or the like in the distribution of crystal orientations in a certain width is only a small part of information in the crystal face distribution and is only related to a small part of particular faces, the crystal face orientation cannot be fully controlled sometimes, and the improvement effect on the bending machinability is insufficient.

SUMMARY OF THE INVENTION

A first technical problem to be solved by the present invention is to provide a copper alloy with excellent electrical conductivity, yield strength, stress relaxation resistance and bending machinability.

A second technical problem to be solved by the present invention is to provide an application of a copper alloy with excellent electrical conductivity, yield strength, stress relaxation resistance and bending machinability.

To address the said first technical problem, the present invention employs the following technical solutions. A copper alloy is provided, which includes the following constituents:

5 wt % to 15 wt % of Zn,
0.2 wt % to 2.5 wt % of Sn,
0.1 wt % to 2.0 wt % of Ni,
0.01 wt % to 0.3 wt % of P,
0 to 0.3 wt % of Mg,
0 to 0.5 wt % of Fe, and
a balance of Cu and inevitable impurities.

During the crystal orientation analysis using EBSD measurement, the area in a Brass orientation {011}<211> at a derivation angle of less than 15° accounts for preferably 10% to 25%.

Further, it is controlled that 1.0 wt %≤Ni+Sn≤3.5 wt %, and the weight ratio of Ni to Sn is 0.08 to 10; and the weight ratio of Ni to P is 2 to 15, and Ni and P form a NiP compound in a matrix.

Further, the copper alloy provided in the above solutions further includes Co.

The content of Co is preferably 0.01 wt % to 2.0 wt %.

Preferably, it is controlled that 0.2 wt %≤Ni+Co≤2.0 wt %.

The copper alloy provided in the above solutions further includes an element X;

the X is at least one selected from Al, Zr, Cr, Mn, B and RE;

wherein the content of Al is 0.01 wt % to 0.8 wt %, the content of Zr is 0.01 wt % to 0.3 wt %, the content of Cr is 0.01 wt % to 0.8 wt %, the content of Mn is 0.01 wt % to 0.8 wt %, the content of B is 0.0005 wt % to 0.2 wt % and the content of RE is 0.0001 wt % to 0.1 wt %.

Further, the grain diameter of the copper alloy is controlled to be 0.5 μm to 10 μm.

Preferably, the 90° bending machinability of the brass alloy strips is controlled as follows: the value R/t in a GW direction is less than or equal to 1 and the value R/t in a BW direction is less than or equal to 2.

The yield strength of the copper alloy strips is greater than 600 MPa, and the electrical conductivity is greater than 25% IACS.

For the second technical problem of the present invention, the copper alloy is particularly suitable for use in connectors, terminals and switch components for electrical components, automobile components and communication devices.

In the present invention, by adding elements such as Ni and P on the basis of Cu—Zn—Sn, controlling the composition proportion between Ni, Sn and P, generating a NiP precipitated phase and dispersedly precipitating the NiP precipitated phase in a matrix, and controlling the texture ratio, the strength and bending performance of the material are improved without reducing the electrical conductivity of the material. On the other hand, since the Cu—Zn—Sn matrix is used in the present invention, the cost of the material can be reduced while meeting the performance requirements. Moreover, since the elements Ni and Sn are contained, more routes are provided to recycle leftovers of nickel-plated and tin-plated copper alloys in industrial chains.

The addition of the element Sn can improve the strength and elasticity of the alloy, and can also improve the stress relaxation resistance of the alloy. Sn is solid-dissolved in the copper alloy in an interstitial solid solution manner, and the degree of lattice distortion caused to the crystal by the interstitial solid solution is larger than that caused by the substitution solid solution, so that it is advantageous for the alloy to have a better work hardening effect during the subsequent machining process and thus the alloy has higher strength. Meanwhile, the work hardening causes the increase of energy stored in the deformed alloy, so it is advantageous to form more nucleating points for the precipitation of a compound NiP during the aging process, so that the effect of improving the uniform distribution of the compound is achieved. Since Sn atoms and Cu atoms differ greatly in radius, by adding the element Sn in the copper alloy, a large lattice distortion can be caused, and the movement of dislocations can be effectively hindered. Particularly, the dislocations can be effectively pinned during the stress relaxation process of the alloy, so that the stress relaxation resistance of the alloy is improved. However, when the content of Sn is less than 0.2 wt %, the effect of improving performances of the alloy is unsatisfactory; and, when the content of Sn exceeds to 2.5 wt %, the electrical conductivity of the alloy will be greatly reduced. Therefore, the content of Sn is controlled to be 0.2 wt % to 2.5 wt % in the present invention.

In the copper alloy, Ni improves the strength of the alloy by solid solution strengthening, but the more important function of Ni in the present invention is to form a NiP phase with P, so that the impact on the electrical conductivity is reduced to the largest extent while further improving the strength of the alloy. The desolation of the elements Ni and P improve the strength and electrical conductivity of the alloy. When the content of Ni is less than or equal to 0.1 wt %, it is not obvious to improve the strength of the alloy. However, when the content of Ni exceeds 2.0 wt %, the content of the precipitated NiP phase after aging is too high, and the content of residual elements Ni and P in the matrix is also increased, so that the electrical conductivity of the alloy is influenced and it is disadvantageous for the bending performance. Therefrom, the content of Ni in the present invention is controlled to be 0.1 wt % to 2.0 wt %.

In the copper alloy of the present invention, the elements of Ni, Sn and P meet the following formulae: the weight percentage of Ni and Sn meets the condition that 1.0 wt %≤Ni+Sn≤3.5 wt %, the weight ratio of Ni to Sn is 0.08 to 10, and the weight ratio of Ni to P is 2 to 15, where Ni and P form a NiP compound in the matrix and the NiP compound is dispersedly precipitated.

The inventor(s) has (have) found that the Ni/Sn ratio is a key factor affecting the performances of the alloy. The elements Ni and Sn are important strengthening elements in the alloy, and the aging strengthening affect of the elements Ni and P, in combination with the work hardening effect of the element Sn, can realize better strengthening effect than the single aging and cold hardening. The proportion of Sn and Ni should meet the following conditions: 1.0 wt %<(Ni+Sn)<3.5 wt % and 0.08<Ni/Sn<10. When the percentage content of Ni and Sn is below the range, the strength of the alloy will be influenced; and, when the percentage content of Ni and Sn is beyond the range, the machinability and electrical conductivity of the alloy will be influenced. When the atomic weight ratio of Ni/Sn is beyond the range of the alloy, the alloy tends to a single aging strengthening or work hardening effect, and the strength of the alloy will be influenced. However, too many alloy elements will influence the electrical conductivity of the alloy.

The element P is a good degassing agent and a deoxidizing agent. A small amount of the element P can be solid-dissolved in the Cu matrix to realize the solid solution strengthening effect. P can form complex NiP compounds with the element Ni, for example $Ni_3P$, $Ni_5P_2$ or $Ni_{12}P_5$. The NiP precipitated compound has an excellent strengthening effect and improves the strength of the alloy. When the content of the element P is too high, it is likely to result in hot rolling cracks, reduced electrical conductivity and increased casting difficulty. The upper limit of P should not exceed 0.3 wt %. When the addition amount of P is less than 0.01 wt %, sufficient NiP compound cannot be formed. The atomic weight ratio of Ni to P should meet the following condition: 2<Ni/P<15. Within this range, the desolation of Ni and P atoms can be realized to the greatest extent, and the aging strengthening affect can be achieved while the residues of the Ni and P atoms in the matrix are reduced to the greatest extent and thus the influence of the added elements on the electrical conductivity of the alloy is reduced as far as possible. Therefore, in the present invention, the content of P is controlled to the 0.01 wt % to 0.3 wt %, and 2<Ni/P<15, so P is completely present in the form of the NiP precipitated phase.

Due to the presence of the precipitated phases in the alloy, the yield strength of the alloy can be significantly improved. If the precipitated phases are finer and more dispersed, the strength of the alloy is higher. During the bending deformation, if the precipitated phases are coarse, it is likely to cause a weak interface, and alloy strips will be cracked during bending. If the precipitated phases are too segregated, it is likely to result local stress concentration, and the alloy strips are also easily cracked during bending. Finely dispersed precipitated phases are beneficial to the bending machinability of the alloy strips, and can improve the stress relaxation resistance of the alloy (the precipitated phases hinder the movement of dislocations during the stress relaxation process). Moreover, the dispersed distribution of the precipitated phases can improve the stability of the stress relaxation resistance of the strips. It is also ensured that the amount of the precipitated phases that are not re-dissolved is as small as possible.

The elements such as Ni and P cannot be completed aged and precipitated, and excessive P in the copper matrix tends to cause the reduction in electrical conductivity of the alloy, so that P is more harmful to the electrical conductivity than Ni. Therefore, a slightly excessive amount of Ni is ensured as far as possible. The atomic weight ratio of Ni/P is controlled within a range of 2 to 5. Beyond this range, there will be excessive elements, so that the electrical conductivity of the alloy is influenced. Since the simultaneous addition of elements such as Sn and Zn in the alloy, these elements affect the maximum solid solubility of the elements such as Ni and P in the face-centered cubic crystal. The inventor(s) has (have) found through lots of researches that, compared with the alloy using only Sn or the precipitation strengthening of Ni and P, the combination of the precipitation strengthening of the elements Ni and P with the work hardening of the element Sn can balance the strength and the electrical conductivity.

In the present invention, by adding the element Zn, the solid solution strengthening effect is realized and the strength of the matrix is improved. On the other hand, Zn has remarkable effects on the improvement of the solder wettability and plated tin adhesion required by the materials of the electrical and electronic components. Moreover, compared with other elements, Zn is cheaper. The cheap waste brass can be used as a raw material source of Zn in the alloy of the present invention, so the cost of the raw material is reduced. If the content of Zn is less than 5 wt %, the solid solution strengthening effect is not obvious, and the reuse of the waste brass will be limited. However, if the content of Zn exceeds 15 wt %, the electrical conductivity and the bending machinability of the alloy will be reduced, and the risk of stress-resistant corrosion and cracking will be increased. Therefore, the content of Zn is controlled to be 5 wt % to 15 wt %.

Mg has the effects of deoxidizing and improving the stress relaxation resistance of the alloy, has little impact on the electrical conductivity of the alloy, and can improve the work hardening effect of the alloy to a certain extent. During the aging precipitation of the alloy, the work hardening effect is improved, and it is advantageous for increasing the energy storage in the material and increasing the nucleating points during the precipitation of the compounds. If the content of Mg is too high, it is likely to reduce the castability and bending machinability of the alloy. Therefore, the content of Mg in the alloy should be controlled less than or equal to 0.3 wt %. The actual control range is 0 to 0.3 wt %.

Fe can refine the crystal gains in the copper alloy and improve the high-temperature strength of the copper alloy. Meanwhile, Fe has a certain precipitation strengthening effect. However, the element Fe has an influence on the electrical conductivity of the alloy. The actual control range of Fe is 0 to 0.5 wt %.

Co and P form a CoP phase. The precipitated strengthening phase has little impact on the electrical conductivity while improving the strength of the alloy. The content of Co is 0.01 wt % to 2.0 wt % in the present invention. The addition of both of Co and Ni is advantageous for the further improvement of the strength and electrical conductivity of the alloy. However, when the content of Ni+Co exceeds 2.0 wt %, there are too many precipitated NiP and CoP phases after aging, and the amount of residual elements Co, Ni and P in the matrix is also increased, so that the electrical conductivity of the alloy is influenced and it is disadvantageous for the bending performance. The actual control range of Ni+Co is 0.2 wt % to 2.0 wt %.

In addition to the above constituents, the copper alloy of the present invention may further contain one or more elements selected from Al, Mn, Cr, Ti, Zr and Ag, in total 0.005 wt % to 2.0 wt %, wherein the content of Al is 0.01 wt % to 0.8 wt %, the content of Zr is 0.01 wt % to 0.3 wt %, the content of Cr is 0.01 wt % to 0.8 wt %, the content of Mn is 0.01 wt % to 0.8 wt %, the content of B is 0.0005 wt % to 0.2 wt % and the content of RE is 0.0001 wt % to 0.1 wt %.

The addition of these elements is advantageous for the improvement of the strength and heat resistance and the refining of crystal grains. Therefore, it may be necessary to add one or two or more of the above elements. If the addition amount of the elements is too large, the electrical conductivity of the copper alloy will be reduced. Therefore, the total addition amount of the elements Al, Mn, Cr, Ti, Zr and Ag is controlled less than or equal to 2.0 wt %.

In the copper alloy of the present invention, during the crystal orientation analysis using EBSD measurement, the area in a Brass orientation {011}<211> at a derivation angle of less than 15° accounts for 10% to 25%.

In the copper alloy plates and strips, there are mainly textures such as Cube orientation, Goss orientation, Brass orientation, Copper orientation and S orientation, and there are crystal faces and crystal orientations corresponding to the textures. Even if in the same crystal system, the proportion of the textures will vary depending on different machining and heat treatment methods. The textures of the plates and strips formed by rolling are represented by faces and directions, where the face is represented by {hkl} and the direction is represented by <uvw>. In this specification, the crystal orientation is represented by a rectangular coordinate system using the rolling direction (RD) of the material as X-axis, the plate width direction (TD) as Y-axis and the rolling normal direction (ND) as Z-axis, and the crystal face index {hkl} perpendicular to the Z-axis and the crystal orientation index <uvw> parallel to the X-axis are represented in the form of {hkl}<uvw>.

By the above notation method, the orientations are expressed as below.

Cube orientation {001}<100>

Goss orientation {011}<100>, Copper orientation {112}<111>

Rotated-Goss orientation {011}<100>{001}<110>

Brass orientation {011}<211>

S orientation {123}<634>

R orientation {124}<211>

The inventor(s) of the present application has (have) found through lots of researches that there is a large correlation between the texture ratio and the bending machinability, and the bending machinability can be significantly improved by controlling a particular texture ratio in a particular copper alloy composition. Meanwhile, it has also been found that the texture ratio of the orientations as mentioned above can be realized by a manufacturing method with a particular process. For the textures of the copper alloy plates in the present invention, in order to ensure that the yield strength of the alloy≥600 MPa, the electrical conductivity≥25% IACS, GW bending R/t≤1 and BW bending R/t≤2, the textures of the alloy in a delivery state should be controlled as below: in accordance with the measured results of the SEM-EBSD method, the area at a derivation angle (orientation difference) of less than 15° relative to the Brass orientation accounts for 10% to 25%. The said analysis of the crystal orientations in the present invention employs the EBSD method. The EBSD, an abbreviation for Electron Backscattered Diffraction, is an orientation analysis technology that reflects electron diffraction by using diffracted Kikuchi lines generated when an electron beam is irradiated onto a surface of an inclined sample within a Scanning Electron Microscope (SEM). The degree of aggregation of the textures of the copper alloy plates at the derivation angle of less than 15° relative to the Brass orientation {011}<211> is measured by the following method: the SEM-based electron microscopic structure is measured by the EBSD, and orientation analysis is performed based on the acquired data by an Orientation Distribution Function (ODF).

As described above, the textures of the copper alloy plates are generally composed of a considerable number of orientation factors. However, if the ratio of the crystal faces changes, the plastic behavior of materials such as plates changes, and the machinability such as bending performance also changes. The names of main texture orientations and the crystal face/orientation indexes of the copper alloy strips in the present invention are as follows: Cube orientation {001}<100>, Copper orientation {112}<111>, Goss orientation {011}<100>, Brass orientation {011}<211>, S orientation {123}<634>, R orientation {124}<211> and Rotated-Goss orientation {001}<110>. The orientations largely correlated to the heat treatment and the rolling process is are Copper orientation {112}<111>, Goss orientation {011}<100>, Brass orientation {011}<211>, S orientation {123}<634> and R orientation {124}<211>, and the crystal grains are gradually transited to the Brass orientation, the S orientation and the Copper orientation during the rolling process of the alloy. The area of the crystal face and crystal orientation of the Brass orientation {011}<211> is relatively large and changes obviously. The rotation of the crystal accelerates the increase of dislocations and the disordered arrangement of atoms. The increased energy storage and lattices detects in the material promote the continuous desolation and uniform fine distribution of precipitates during the subsequent aging process, so that the electrical conductivity, yield strength and bending machinability of the material are improved. The inventor(s) has (have) found that, when the area of the Brass orientation {011}<211> at the derivation angle of less than 15° does not meet 10% to 25%, the strength or bending machinability of the alloy will be deteriorated obviously.

In the copper alloy of the present invention, the average grain diameter is 0.5 μm to 10 μm.

In order to further improve the bending machinability of the alloy in the present invention, the average grain diameter is preferably 0.5 μm to 10 μm. If the crystal grains are finer, it is more advantageous for the improvement of the yield strength of the alloy, the deformation is more uniform since more crystal grains participate in the co-deformation during the bending deformation of the alloy strips, and the surface roughness after the bending deformation is lower. However, if the crystal grains are too fine, it is likely to reduce the stress relaxation resistance of the strips. In order to further achieve the strength, the alloy strips often needs to be cold-deformed after aging. To ensure the bending machinability of the alloy strips under these conditions, it is necessary to ensure that the microstructure is completely recrystallized after aging, and the grain size is controlled between 0.5 μm and 10 μm.

A method for preparing the copper alloy in the above solutions may be described below.

The method includes the following steps:

1) preparing materials: preparing each constituent in proportion;

2) smelting: smelting the copper alloy raw materials at 1000° C. to 1300° C. by a conventional copper alloy smelting method, and semi-continuously casting the copper alloy raw materials to obtain an ingot;

3) hot rolling: performing hot rolling at 750° C. to 900° C., and maintaining the temperature for 3 h to 6 h;

4) milling: removing the oxidized skin on the surface of the hot-rolled alloy, and milling upper and lower surface of the hot-rolled plate by 0.5 mm to 1.0 mm;

5) primary cold rolling: controlling the total rolling ratio within a range of 30% to 95%, preferably 70% to 90%;

6) primary aging: controlling the aging temperature within a range of 350° C. to 600° C., and maintaining for 6 h to 12 h;

7) secondary cold rolling: controlling the deformation of the secondary cold rolling as ≥60%;

8) secondary aging: controlling the aging temperature within a range of 350° C. to 550° C., preferably 400° C. to 550° C., and maintaining for 6 h to 12 h, preferably 6 h to 10 h;

9) finish rolling: controlling the deformation within a range of 5% to 60%;

10) low-temperature annealing: controlling the temperature for the low-temperature annealing within a range of 200° C. to 250° C., and maintaining for 1 h to 6 h; and 11) cleaning the obtained product, dividing into strips, and packaging.

Or, the method includes the following steps:

1) preparing materials: preparing each constituent in proportion;

2) horizontal continuous casting: smelting the copper alloy raw materials at 1000° C. to 1300° C. by a conventional copper alloy smelting method, and continuously casting the copper alloy raw materials to obtain an ingot;

3) milling: removing the oxidized skin on the surface of the hot-rolled alloy, and milling upper and lower surface of the hot-rolled plate by 0.5 mm to 1.0 mm;

4) primary cold rolling: controlling the total rolling ratio within a range of 30% to 95%, preferably 70% to 90%;

5) solid solution treatment: performing for 1 min to 1 h at a temperature of 700° C. to 980° C.;

6) secondary cold rolling: controlling the deformation of the secondary cold rolling as ≥60%;

7) aging treatment: controlling the aging temperature within a range of 350° C. to 550° C., preferably 400° C. to 550° C., and maintaining for 6 h to 12 h, preferably 6 h to 10 h;

8) finish rolling: controlling the deformation within a range of 5% to 60%;

9) low-temperature annealing: controlling the temperature for the low-temperature annealing within a range of 200° C. to 250° C., and maintaining for 1 h to 6 h; and 10) cleaning the obtained product, dividing into strips, and packaging.

Wherein:

Smelting: the conventional copper alloy smelting method is employed to melt the copper alloy raw materials, and the copper alloy raw materials are then cast continuously or semi-continuously to obtain an ingot, where the smelting temperature is 1000° C. to 1300° C.

Hot rolling: to ensure the coarse precipitated phases in the ingot to be solid-dissolved in the matrix, the hot rolling temperature is controlled within a range of 750° C. to 900° C., and the temperature maintaining time is 3 h to 6 h. In this process, the purpose of homogenizing the alloy can be achieved. To reduce the precipitation of the hot-rolled phase particles as far as possible, the finish rolling temperature of the alloy is controlled greater than or equal to 650° C. Preferably, the alloy is quenched by water cooling, and the rolling ratio is ensured to be greater than or equal to 85%.

Milling: since the oxidized skin on the hot-rolled surface is thick, in order to ensure the surface quality of the strips in the later stage, the upper and lower surfaces of the hot-rolled plate are milled by 0.5 mm to 1.0 mm.

Primary cold rolling: in the first cold rolling step, the total rolling ratio is required to be equal to or greater than 30%. However, if the rolling ratio of the first cold rolling is too high, the bending machinability of the final finished copper alloy plate is poor. Therefore, the total rolling ratio of the first cold rolling is preferably 30% to 95%, more preferably 70% to 90%.

The solid solution treatment is a heat treatment for re-forming a solid solution of a solute element in the matrix and then recrystallizing the solid solution. At the end of the solid solution treatment, the proportion of Brass orientation {011}<211> and S orientation {123}<634> in the rolling direction is decreased, so it is advantageous for the molding of the alloy and it is convenient for the later cold machining. The solid solution treatment is preferably performed at 700° C. to 980° C. for 1 min to 1 h, more preferably for 10 min to 50 min. If the temperature for the solid solution treatment is too low, the recrystallization is performed incompletely, which is disadvantageous for controlling the Brass orientation {011}<211> and S orientation {123}<634> in the rolling direction, and is disadvantageous for the subsequent machining. As a result, the solute element is dissolved in the solid solution again incompletely. On the other hand, if the temperature for the solid solution treatment is too high, the crystal grains become coarse, and the bending machinability of the plate is liable to be deteriorated.

The primary aging treatment is mainly for the purpose of precipitating the second phase and softening the microstructure. Compared with the cold-rolled state, the aged alloy has a relatively small distribution proportion of the Brass orientation {011}<211>, Goss orientation {011}<100>, Copper orientation {112}<111>, S orientation {123}<634> and R orientation {124}<211>, and the alloy has better plasticity. The aging temperature is controlled at 350° C. to 600° C., and the maintaining time is 6 h to 12 h; more preferably, the temperature is controlled at 400° C. to 550° C., and the maintaining time is 6 h to 10 h. In this way, Ni and P form a compound, and the compound is dispersedly precipitated in a fine shape in the copper parent phase, so that high strength and excellent bending machinability can be achieved at the same time. If the aging temperature is too high and the time is too long, the precipitates become coarse, and the best balance between the strength and the grain size cannot be achieved. Conversely, if the temperature is too low and the time is too short, the precipitation cannot be performed completely, and the desired value of the bending machinability and the strength cannot be fully achieved.

Secondary cold rolling: the heat-treated copper alloy material is cold-rolled, and the Copper orientation {112}<111>, Goss orientation {011}<100>, Brass orientation {011}<211>, S orientation {123}<634> and R orientation {124}<211> in the rolling direction are gradually increased with the progress of the cold rolling. The rotation of the crystal accelerates the increase of dislocations and the disordered arrangement of atoms. The increased energy storage and lattices detects in the material promote the continuous desolation and uniform fine distribution of precipitates during the subsequent aging process, so that the electrical conductivity, yield strength and bending machinability of the material are improved. Therefore, the deformation of the secondary cold rolling is controlled greater than or equal to 60%. If the deformation is too low, the uniform dispersity of the precipitated phase is low, and the amount of precipitation is small. Meanwhile, it is disadvantageous for the complete recrystallization of the aged microstructure in the later stage, and it is finally disadvantage for the bending of the strips.

Secondary aging treatment: it is a key process for the precipitation strengthening of the alloy. The aging temperature is controlled at 350° C. to 550° C., and the temperature maintaining time is 6 h to 12 h. Preferably, the aging temperature is controlled at 400° C. to 500° C., and the time is 6 h to 10 h. The high temperature is beneficial to the complete recrystallization of the microstructure and the precipitation of the second phase. However, if the temperature is too high, it is likely to result in the aggregation and over-aging of the precipitates. The low-temperature aging is disadvantageous for the recrystallization of the strips and the precipitation of the second phase. The proportion of the Copper orientation {112}<111>, Goss orientation (110)<001>{011}<100>, Brass orientation {011}<211>, S orientation {123}<634> and R orientation {124}<211> in the rolling direction is relatively large, which has a great influence on the bending process of the strips.

Finish rolling: by performing cold deformation on the aged alloy, it is advantageous for the further improvement of the strength of the strips. However, the deformation should not be too large. If the deformation is too large, it is likely to form obvious anisotropy, so that is disadvantageous for the bending machinability of the strips in the BW direction, and the control of the grain diameter of the alloy will be influenced. With the increase of the machinability, the distribution proportion of the Copper orientation {112}<111>, Goss orientation {011}<100>, Brass orientation {011}<211>, S orientation {123}<634> and R orientation {124}<211> in the rolling direction is increased, where the increase trend of the Brass orientation {011}<211> is particularly obvious. The rotation of the crystal face and crystal orientation causes the deterioration of the deformation coordination of the crystal and the deterioration of the bending performance of the alloy. The deterioration in the BW direction is more obvious. Therefore, the deformation is controlled less than or equal to 60%.

Low-temperature annealing: for a copper alloy with a higher zinc content, the low-temperature annealing after the cold deformation is advantageous for the improvement of the yield strength and the bending machinability. Meanwhile, the precipitation of a small amount of compound can improve the electrical conductivity of the alloy and release a certain amount of residual stress, and it is advantageous for the adjustment of the grain diameter. Therefore, low-temperature annealing is performed on the copper alloy plate after the third cold rolling. The temperature for the low-temperature annealing is controlled between 200° C. and 250° C. If the temperature is too high, the copper alloy plate will be softened within a short time, and the strength characteristic of the alloy is lowered, so that it is disadvantage for use. On the other hand, if the temperature is too low, the effects of improving the above performances cannot be fully achieved.

Compared with the prior art, the present invention has the following advantages.

(1) In the alloy of the present invention, by adding elements such as Ni and P on the basis of Cu—Zn—Sn, controlling the composition proportion between Ni, Sn and P, generating a NiP precipitated phase and dispersedly precipitating the NiP precipitated phase in a matrix, and controlling the texture ratio, the strength and bending performance of the material are improved while maintaining the electrical conductivity of the material.

(2) On the other hand, since the Cu—Zn—Sn matrix is used in the present invention, the cost of the material can be reduced while meeting the performance requirements. Moreover, since the elements Ni and Sn are contained, more routes are provided to recycle leftovers of nickel-plated and tin-plated copper alloys in industrial chains. Also, the alloy can be used to replace alloys represented by C51900 tin-phosphor bronze.

(3) After the alloy of the present invention is subjected to aging and cold rolling deformation, the yield strength can be greater than or equal to 600 MPa, and the electrical conductivity can be greater than or equal to 25% IACS. The 90° bending machinability of the brass alloy strips is that the value R/t in the GW direction is less than or equal to 1 and the value R/t in the BW direction is less than or equal to 2. After the alloy is maintained at 150° C. for 1000 h, the residual stress is greater than or equal to 60%, and the stress relaxation resistance is excellent.

(4) The alloy of the present invention can be machined into rods, lines, plates, strips and other products, and be widely applied to connectors, terminals and switch components for electrical components, automobile components, communication devices and the like.

BRIEF DESCRIPTION OF THE DRAWINGS

FIG. 1 is a scanning electron micrograph of the alloy according to Embodiment 1 of the present invention, where the horizontal line at the lower right corner is a dimension scale line and the area circled by the boundary line represents one crystal grain.

DETAILED DESCRIPTION OF THE PREFERRED EMBODIMENT

To enable a further understanding of the present invention content of the invention herein, refer to the detailed description of the invention and the accompanying drawings below:

Each of raw materials of the copper alloys was prepared according to the constituents shown in the embodiments in Table 1, then smelted at 1120° C. to 1200° C. by semi-continuous casting, and manufactured into each ingot in 440 mm×250 mm. Each ingot was maintained at 850° C. for 5 h, and then hot-rolled to allow each plate thickness to be 16.5 mm. Then, due to the surface descaling, the surface of each hot-rolled plate was to be milled. The upper and lower surfaces of each hot-rolled plate were milled by 0.5 mm to 1.0 mm to allow the thickness of each hot-rolled plate to be 15 mm. Subsequently, primary code rolling was performed to obtain each plate having a thickness of 2 mm. Each plate subjected to the primary cold rolling was heated to 440° C. and then maintained at this temperature for 8 h, and primary aging was performed. Secondary cold rolling was performed on each plate subjected to the primary aging until the thickness was 0.35 mm, and then each plate was subjected to secondary aging and maintained at 400° C. for 8 h. Finally, finish rolling was performed to obtain each target plate thickness of 0.2 mm. At the end of the finish rolling, each plate was subjected to low-temperature annealing and maintained at 210° C. for 4 h to obtain each strip sample.

The scanning electron micrograph of the alloy according to Embodiment 1 of the present invention is shown in FIG. 1, where the horizontal line at the lower right corner is a dimension scale line and the area circled by the boundary line represents one crystal grain. For the prepared strip samples of the alloys in 20 embodiments and the alloys in 7 comparison embodiments, the mechanical performance, electrical conductivity, stress relaxation resistance, bending performance and crystal orientation were tested, respectively.

The room-temperature tensile tests were carried out by an electronic universal mechanical property testing machine according to GB/T228.1-2010 Metal Material Tensile Test Section 1: Test At Room Temperature. The samples each having a width of 12.5 mm were used, and the tensile speed was 5 mm/min.

The electrical conductivity tests were carried out according to GB/T3048.2-2007 Test Methods for Electrical Performance of Electric Wires and Cables Section 2: Metal Material Resistivity Test. As the test instrument, a ZFD microcomputer bridge DC resistance tester was used, and the samples each was 20 mm in width and 500 mm in length.

The average grain size was measured by selecting an appropriate magnification according to the size of crystal grains in metal microphotographs by 600 times, 300 times, 150 times or the like. The tests were carried out according to the quadrature method in JIS H0501: 1986 Test Method for Grain Size of Copper Products. The twinned crystals were not regarded as crystal grains. The samples each was 10 mm in width and 10 mm in length.

The stress relaxation resistance tests were carried out according to JCBA T309: 2004 Test Method for Bending Stress Relaxation Resistance of Copper and Copper Alloy Sheets and Strips. The sampling was performed parallel to the rolling direction, and the samples each was 10 mm in width and 100 mm in length. The initial loading stress value was 0.2%, the yield strength was 80%, the test temperature was 150° C., and the time was 1000 h.

The bending performance tests were carried out by a bending testing machine according to GBT 232-2010 Bending Test Method for Metal Materials. The samples each was 5 mm in width and 50 mm in length.

Texture tests were carried out by a Pegasus XM2 EBSD apparatus according to GBT 30703-2014 Guidelines for Electron Backscattering Diffraction Orientation Analysis Methods for Microbeam Analysis. The samples each was 10 mm in width and 10 mm in length.

The constituents and performance results in the embodiments and comparison embodiments were shown in Tables 1 and 2.

It could be observed from the embodiments, for all the copper alloys in the embodiments of the present invention, the yield strength was ≥600 MPa; the electrical conductivity was ≥25% IACS; the bending machinability was excellent, that is, the value R/t in the GW direction was less than or equal to 1, and the value R/t in the BW direction was less than or equal to 2; and, the stress relaxation resistance was a material performance with the residual stress of ≥60% under the conditions that the alloy was maintained at 150° C. for 1000 h and the loading stress was 80% of the yield strength. Meanwhile, it could be observed from the comparison of Embodiment 13 and Embodiment 19 that, the performance achieved in the case of completely adding Ni could be achieved by replacing a part of Ni with Co. It could be observed from Embodiments 11, 12 and 19 that the addition of Fe could improve the strength of the material and Mg facilitated the improvement of the stress relaxation resistance.

It could be observed from the comparison embodiments 1 to 4 that, when the ratios of Ni, Sn and P did not meet all of the following conditions: 1.0 wt %≤Ni+Sn≤3.5 wt %, 2≤Ni/P≤15 and 0.08≤Ni/Sn≤10, the desired performances of the material cannot be met. It could be observed from the comparison embodiments 5 and 6 that, when the area of Brass orientation {011}<211> at the derivation angle of less than 15° did not meet 10% to 25%, the bending machinability of the material was low. It could be observed from the comparison embodiment 7 that, when the average grain size of the material was not 0.5 μm to 10 μm, the bending machinability and the stress relaxation resistance of the alloy were reduced obviously and the desired performances of the material cannot be met.

TABLE 1

| | | The content of element/wt % | | | | | | | | |
|---|---|---|---|---|---|---|---|---|---|---|
| | No. | Zn | Ni | Sn | P | Others | Cu | Ni/Sn | Ni/P | Ni + Sn |
| Embodiment | 1 | 8.52 | 0.26 | 0.84 | 0.09 | — | The balance | 0.31 | 2.89 | 1.1 |
| | 2 | 7.33 | 1.1 | 1.28 | 0.27 | — | | 0.86 | 4.07 | 2.38 |
| | 3 | 5.04 | 1.24 | 1.65 | 0.23 | — | | 0.75 | 5.39 | 2.89 |
| | 4 | 9.36 | 1.89 | 0.61 | 0.19 | — | | 3.10 | 9.95 | 2.5 |
| | 5 | 11.77 | 1.64 | 0.2 | 0.17 | — | | 8.20 | 9.65 | 1.84 |
| | 6 | 12.13 | 0.55 | 0.73 | 0.18 | — | | 0.75 | 3.06 | 1.28 |
| | 7 | 10.11 | 1.07 | 1.95 | 0.28 | — | | 0.50 | 3.46 | 3.02 |
| | 8 | 13.52 | 0.14 | 0.87 | 0.03 | — | | 0.16 | 4.67 | 1.01 |
| | 9 | 6.35 | 0.65 | 1.79 | 0.12 | | | 0.36 | 5.42 | 2.44 |
| | 10 | 11.73 | 1.21 | 1.62 | 0.15 | | | 0.75 | 8.07 | 2.83 |
| | 11 | 13.69 | 0.64 | 1.64 | 0.09 | Mg:0.12 | | 0.39 | 7.11 | 2.28 |
| | 12 | 6 | 0.21 | 1.06 | 0.03 | Fe:0.15 | | 0.20 | 7.00 | 1.27 |
| | 13 | 14.64 | 0.55 | 0.54 | 0.05 | Co:0.55 | | 1.02 | 11.00 | 1.09 |
| | 14 | 5.98 | 0.35 | 1.45 | 0.07 | Al:0.20 | | 0.24 | 5.00 | 1.8 |
| | 15 | 7.09 | 1.51 | 0.49 | 0.3 | Zr:0.1 | | 3.08 | 5.03 | 2 |
| | 16 | 5.06 | 0.94 | 1.46 | 0.1 | Cr:0.15 | | 0.64 | 9.40 | 2.4 |
| | 17 | 11.98 | 2.42 | 0.73 | 0.92 | Mn:0.12 | | 1.75 | 4.74 | 3.34 |
| | 18 | 5.85 | 1.13 | 1.61 | 0.16 | B:0.08 | | 0.70 | 7.06 | 2.74 |
| | 19 | 9.01 | 0.77 | 1.56 | 0.17 | Mg:0.12 Co:0.09 | | 0.49 | 4.53 | 2.33 |
| | 20 | 14.35 | 1.92 | 0.31 | 0.29 | RE:0.18 | | 6.19 | 6.62 | 2.23 |
| Comparison embodiment | 1 | 13.50 | 1.01 | 2.42 | 0.10 | | | 0.42 | 10.00 | 3.43 |
| | 2 | 14.96 | 0.14 | 1.10 | 0.10 | | | 0.12 | 1.38 | 1.24 |
| | 3 | 12.45 | 1.77 | 1.10 | 0.05 | | | 1.61 | 36.35 | 2.86 |
| | 4 | 6.15 | 0.25 | 0.90 | 0.17 | | | 0.28 | 1.45 | 1.15 |
| | 5 | 9.19 | 1.75 | 0.52 | 0.18 | | | 3.39 | 9.48 | 2.27 |
| | 6 | 10.69 | 0.29 | 2.11 | 0.17 | | | 0.14 | 1.66 | 2.39 |
| | 7 | 5.15 | 0.88 | 1.36 | 0.26 | | | 0.65 | 3.43 | 2.23 |
| | C26000 | 70.0 | | | | | | | | |
| | C51900 | | | 6.0 | 0.1 | | | | | |
| | C42500 | 9.0 | | 3.0 | | | | | | |

TABLE 2

| | No. | Yield strength/ MPa | Ductility/ % | Electrical conductivity/ % IACS | Residual stress/% | Bending 90° R/t GW | Bending 90° R/t BW | The proportion the area of the Brass orientation at the deviation angle of less than 15°/% | Average grain diameter/ μm |
|---|---|---|---|---|---|---|---|---|---|
| Embodiment | 1 | 612 | 5 | 38.2 | 64 | 1 | 2 | 21.7 | 2 |
| | 2 | 645 | 4 | 31.2 | 72 | 0.5 | 1.5 | 18.2 | 7 |
| | 3 | 649 | 5 | 33.2 | 73 | 0.5 | 1 | 14.1 | 6 |
| | 4 | 637 | 6 | 32.5 | 72 | 1 | 2 | 24.5 | 8 |
| | 5 | 628 | 4 | 35.7 | 70 | 1 | 2 | 23.6 | 6 |
| | 6 | 623 | 4 | 34.8 | 70 | 1 | 2 | 20.8 | 7 |
| | 7 | 656 | 5 | 28.7 | 71 | 0.5 | 0.5 | 10.4 | 8 |
| | 8 | 608 | 5 | 32.3 | 61 | 1 | 2 | 21.3 | 10 |
| | 9 | 649 | 6 | 29.7 | 70 | 0.5 | 0.5 | 14.7 | 5 |
| | 10 | 691 | 5 | 29.3 | 73 | 0.5 | 1 | 14.2 | 1 |
| | 11 | 637 | 4 | 30.5 | 71 | 0.5 | 1 | 19.2 | 9 |
| | 12 | 618 | 5 | 36.3 | 65 | 0.5 | 1.5 | 21.6 | 3 |
| | 13 | 625 | 4 | 29.8 | 68 | 0.5 | 2 | 22.7 | 7 |
| | 14 | 631 | 5 | 32.7 | 67 | 0.5 | 1 | 16.5 | 5 |
| | 15 | 627 | 4 | 34.2 | 74 | 0.5 | 1 | 19.7 | 8 |
| | 16 | 639 | 5 | 35.1 | 72 | 0.5 | 1 | 18.6 | 8 |

TABLE 2-continued

| | No. | Yield strength/ MPa | Ductility/ % | Electrical conductivity/ % IACS | Residual stress/% | Bending 90° R/t GW | Bending 90° R/t BW | The proportion the area of the Brass orientation at the deviation angle of less than 15°/% | Average grain diameter/ μm |
|---|---|---|---|---|---|---|---|---|---|
| | 17 | 708 | 5 | 30.5 | 71 | 1 | 1.5 | 22.8 | 2 |
| | 18 | 642 | 6 | 33.7 | 72 | 0.5 | 1 | 15.3 | 7 |
| | 19 | 636 | 4 | 29.6 | 70 | 0.5 | 1 | 16.7 | 5 |
| | 20 | 632 | 5 | 28.4 | 73 | 1 | 2 | 23.9 | 0.5 |
| Comparison embodiment | 1 | 669 | 5 | 24.8 | 70 | 1.5 | 2.5 | 20.1 | 6 |
| | 2 | 587 | 4 | 33 | 55 | 1 | 2 | 18.1 | 8 |
| | 3 | 618 | 8 | 25.6 | 56 | 1 | 2 | 16.9 | 7 |
| | 4 | 590 | 6 | 23.8 | 58 | 0.5 | 1.5 | 12 | 5 |
| | 5 | 625 | 4 | 33 | 70 | 1.5 | 2.5 | 30 | 7 |
| | 6 | 615 | 5 | 31.5 | 68 | 2 | 2.5 | 8 | 9 |
| | 7 | 601 | 5 | 32.5 | 61 | 2 | 3 | 16.9 | 20 |
| | C26000 | 520 | 5 | 28 | 40 | | | | |
| | C51900 | 650 | 7 | 16.0 | 50 | | | | |
| | C42500 | 560 | 6 | 28.0 | 50 | | | | |

The invention claimed is:

1. A copper alloy, wherein the copper alloy comprises:

5 wt % to 15 wt % of Zn, 0.2 wt % to 2.5 wt % of Sn, 0.1 wt % to 2.0 wt % of Ni, 0.01 wt % to 0.3 wt % of P, 0 to 0.3 wt % of Mg, 0 to 0.5 wt % of Fe, and a balance of Cu and inevitable impurities, and wherein, during the crystal orientation analysis using EBSD measurement, an area in a Brass orientation {011}<211> at a derivation angle of less than 15° accounts for 10% to 25%.

2. The copper alloy according to claim 1, wherein 1.0 wt %≤Ni+Sn≤3.5 wt %, and a weight ratio of Ni to Sn is 0.08 to 10; and a weight ratio of Ni to P is 2 to 15, and Ni and P form a NiP compound in a matrix.

3. The copper alloy according to claim 1, further comprising 0.01% to 2.0 wt % of Co.

4. The copper alloy according to claim 1, wherein 0.2 wt %≤Ni+Co≤2.0 wt %.

5. The copper alloy according to claim 1, further comprising an element X;

the X is at least one selected from Al, Zr, Cr, Mn, B and Re;

wherein a content of Al is 0.01 wt % to 0.8 wt %, a content of Zr is 0.01 wt % to 0.3 wt %, a content of Cr is 0.01 wt % to 0.8 wt %, a content of Mn is 0.01 wt % to 0.8 wt %, a content of B is 0.0005 wt % to 0.2 wt % and a content of Re is 0.0001 wt % to 0.1 wt %.

6. The copper alloy according to claim 1, wherein a grain diameter of the copper alloy is 0.5 μm to 10 μm.

7. The copper alloy according to claim 1, wherein a 90° bending machinability of a strip of the copper alloy is that a value R/t in a GW direction is less than or equal to 1 and a value R/t in a BW direction is less than or equal to 2.

8. The copper alloy according to claim 1, wherein an yield strength of a strip of the copper alloy is greater than 600 MPa.

9. The copper alloy according to claim 2, further comprising an element X;

the X is at least one selected from Al, Zr, Cr, Mn, B and Re;

wherein a content of Al is 0.01 wt % to 0.8 wt %, a content of Zr is 0.01 wt % to 0.3 wt %, a content of Cr is 0.01 wt % to 0.8 wt %, a content of Mn is 0.01 wt % to 0.8 wt %, a content of B is 0.0005 wt % to 0.2 wt % and a content of Re is 0.0001 wt % to 0.1 wt %.

10. The copper alloy according to claim 3, further comprising an element X;

the X is at least one selected from Al, Zr, Cr, Mn, B and Re;

wherein a content of Al is 0.01 wt % to 0.8 wt %, a content of Zr is 0.01 wt % to 0.3 wt %, a content of Cr is 0.01 wt % to 0.8 wt %, a content of Mn is 0.01 wt % to 0.8 wt %, a content of B is 0.0005 wt % to 0.2 wt % and a content of Re is 0.0001 wt % to 0.1 wt %.

11. The copper alloy according to claim 4, further comprising an element X;

the X is at least one selected from Al, Zr, Cr, Mn, B and Re;

wherein a content of Al is 0.01 wt % to 0.8 wt %, a content of Zr is 0.01 wt % to 0.3 wt %, a content of Cr is 0.01 wt % to 0.8 wt %, a content of Mn is 0.01 wt % to 0.8 wt %, a content of B is 0.0005 wt % to 0.2 wt % and a content of Re is 0.0001 wt % to 0.1 wt %.

* * * * *